US005734994A

United States Patent [19]

Rogers

[11] Patent Number: 5,734,994

[45] Date of Patent: Apr. 7, 1998

[54] VENTILATED SAFETY HELMET WITH PROGRESSIVELY CRUSHABLE LINER

[75] Inventor: David C. Rogers, Boston, Mass.

[73] Assignees: M.P.H. Associates, Inc., Norwood; De De Design, Inc., Boston, both of Mass.

[21] Appl. No.: 796,914

[22] Filed: Feb. 6, 1997

[51] Int. Cl.[6] ..... A42B 3/00

[52] U.S. Cl. ..... 2/411; 2/425

[58] Field of Search ..... 2/410, 411, 425, 2/424, 171.3

[56] References Cited

U.S. PATENT DOCUMENTS

| | | | |
|---|---|---|---|
| 4,307,471 | 12/1981 | Lovell . | |
| 4,434,514 | 3/1984 | Sundahl et al. | 2/425 |
| 4,555,816 | 12/1985 | Broersma | 2/425 |
| 4,612,675 | 9/1986 | Broersma | 2/425 |
| 4,724,549 | 2/1988 | Herder et al. | 2/425 |
| 4,995,117 | 2/1991 | Mirage | 2/411 |
| 5,093,937 | 3/1992 | Kamata | 2/425 |
| 5,337,421 | 8/1994 | Jeng . | |

*Primary Examiner*—Gloria M. Hale
*Attorney, Agent, or Firm*—Cesari and McKenna, LLP

[57] ABSTRACT

A safety helmet has a hard outer shell having front and rear edges. A bowl-shaped liner with front and rear edges and a peak between the edges is contoured to fit snugly in the shell so that the front and rear edges of the liner are adjacent to the front and rear edges of the shell. The liner has an interior surface contoured generally to fit a wearer's head and a corrugated exterior surface, the tips of the liner corrugations contacting the shell along multiple lines of contact. The corrugations in at least a central zone of the liner adjacent to the peak extend fore and aft between the front and rear edges of the liner such that the corrugations define valleys that are spaced from the shell to provide air passages in the helmet extending from the front of the helmet to an array of through-holes in the liner and to a vent opening in the shell adjacent to the rear edge of the liner. A valve is provided to control air flow through the passages and the through-holes. Preferably also, the liner is of a crushable material so that the liner corrugations provide progressive crushability to protect against lower energy impacts.

25 Claims, 2 Drawing Sheets

VENTILATED SAFETY HELMET WITH PROGRESSIVELY CRUSHABLE LINER

The present invention relates to an aerodynamic ventilated safety helmet for skiers, snowboarders and the like that is also designed to protect the wearer's head from impacts over a wide range of G forces. Certain aspects of the invention may also be applied to headgear for other sports, including cycling and motorsports.

BACKGROUND OF THE INVENTION

More and more skiers, snowboarders, roller bladers, etc. are wearing protective helmets to safeguard against head injury. In fact, their use is mandated in some localities.

Such safety helmets often comprise a hard outer shell and a softer lining of a cushioning material able to absorb energy resulting from impacts to the helmet. In some helmets, the cushioning material is a resilient material such as foam rubber. In others, the cushioning material is a crushable substance such as expanded polystyrene. See, for example, U.S. Pat. Nos. 4,307,471 and 5,337,421.

While prior helmets of both types provide significant protection to the wearer, neither type is able to satisfactorily protect the wearer's head from impacts over the wide range of G forces likely to be encountered as a result of falls, striking stationary objects, etc. In other words, while resilient foam materials are able to cushion low energy impacts, they do not provide sufficient protection against high speed impacts of, say, 50 G's or more. On the other hand, the crushable liners, which are dense enough to provide good protection against high G-force impacts, are less effective in absorbing lower speed impacts which are still significant enough to cause serious head injury.

Since protective helmets of this general type cover a considerable portion of the wearer's head, another consideration in the design of such helmets should be the maintenance of sufficient air circulation through the helmet to prevent the wearer's head from overheating. Bearing in mind that these helmets may be worn in drastically different climates, from the mountains in Maine to the deserts in New Mexico, it would be highly advantageous to provide a safety helmet that enables the wearer to adjust the air circulation through the helmet depending upon factors such as ambient temperature, sun load on the helmet and degree of wearer exertion.

SUMMARY OF THE INVENTION

Accordingly, it is a primary object of the present invention to provide an improved protective helmet for downhill skiers; snowboarders and the like which protects the wearer's head against impacts over a wide range of G forces.

A secondary object of the invention is to provide such a helmet which may be adapted to other sports such as cycling and motorsports.

Another object of the invention is to provide a helmet of this type which is relatively light weight and comfortable to wear.

Another object is to provide such a helmet which has an aerodynamic exterior shape.

A further object of the invention is to provide a safety helmet which incorporates adjustable air ventilation.

Yet another object of the invention is to provide a protective helmet which is relatively economical to make.

Still another object of the invention is to provide a protective helmet which is quite versatile in that it can be made with or without side pieces to cover the sides of the wearer's face.

Other objects will, in part, be obvious and will, in part, appear hereinafter.

The invention accordingly comprises the features of construction, combination of elements, and arrangement of parts which will be exemplified in the following detailed description, and the scope of the invention will be indicated in the claims.

Briefly, my protective helmet comprises a rigid outer shell which is molded to provide an aerodynamic exterior and a recessed interior for receiving the head of a wearer. Positioned inside the outer shell and lining the wall of the recess therein is a special crushable domed liner whose outer surface is formed with an array of ridges which may extend between the front and rear edges of the liner. When the liner is properly positioned in the shell, the peaks of the ridges form lines of contact between the liner and the inner surface of the outer shell. The helmet may also include a soft resilient inner liner which is shaped to fit snugly around the wearer's head to provide maximum comfort, and a chin strap whose ends are connected to opposite sides of the shell for holding the helmet on the wearer's head.

As will be described in more detailed later, the ridged design of the liner provides progressive crushability. In other words, the peaked shape of the ridges allows progressively more of the liner volume to crush under progressively greater impact forces on the helmet. Thus, the helmet is able to absorb most of the energy due to impact forces which may be well below the absorption capacity of the liner, but which are still significant enough to cause serious head injury if a conventional safety helmet were being worn.

In other words, unlike prior helmet liners, less than critical impact forces are absorbed by the weaker or more crushable ridged portions of the present liner while the main body of the liner is still able to absorb most of the energy from impacts at higher force levels.

In addition to providing protection against head impacts, the ridged liner of my helmet allows for the controlled circulation of air through the helmet. More particularly, the exterior surface of the liner has valleys between the ridges which form conduits that lead to an array of through-holes or chimneys extending through the liner to the interior of the helmet. Openings are provided between the leading edges of the outer shell and the liner which allow air to enter the front of the helmet between the outer shell and the liner. That air may travel back along the aforesaid conduits and through the chimneys to a protected exit opening provided in the back of the outer shell. Thus, as the helmet wearer moves forward, air is forced into the front of the helmet and circulated along the air conduits and through the chimneys and along the inner surface of the liner in close proximity to the wearer's head thereby providing a significant cooling effect.

Preferably, the circulation of air through the helmet is controlled by a simple sliding valve mechanism which fits between the liner and the outer shell. When the valve mechanism is in its closed position, it blocks the entrance openings into the air conduits and chimneys and prevents circulation of air through the helmet. The valve mechanism can be opened in varying degrees to allow a specific amount of air circulation through the interior of the helmet via the chimneys. In this way, the helmet wearer can select an amount of venting to suit his or her particular comfort level.

As we shall see, my helmet is composed of a relatively few main parts which can be molded in quantity on an economical basis. Furthermore, the helmet is easy to assemble. Therefore, the overall cost of the helmet can be kept to a minimum.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION OF THE PREFERRED EMBODIMENT

Figure 1:
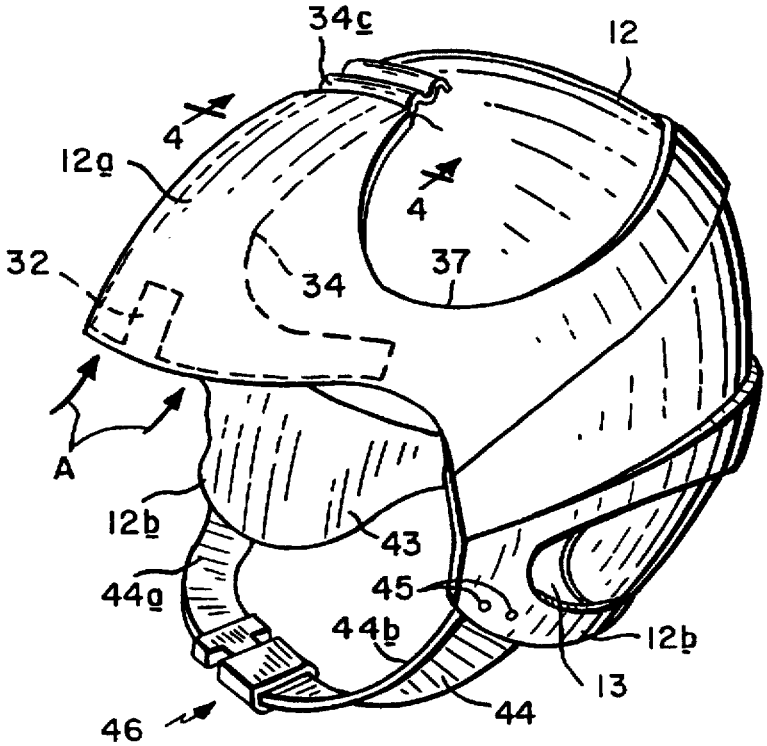
FIG. 1 is a left front perspective view showing a safety helmet incorporating my invention.
Figure 2:
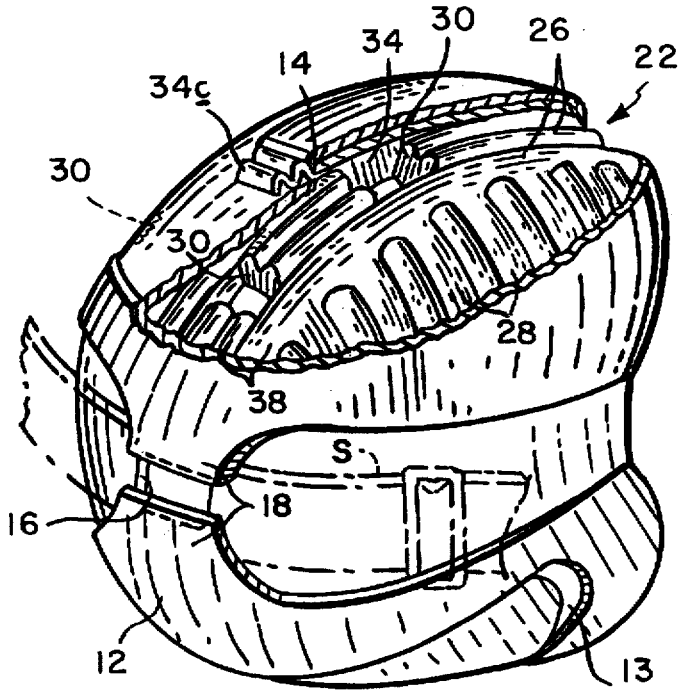
FIG. 2 is a right rear perspective view, with parts broken away, thereof.

Referring to FIGS. 1 and 2 of the drawings, the subject helmet comprises a rigid outer shell 12 molded with an aerodynamic exterior shape of a suitable strong impact-resistant material such as ABS or polycarbonate plastic. The illustrated shell 12 has a top portion 12*a* and side portions 12*b* which extend down over the sides of the wearer's face and ears. Preferably, recessed arcuate slots 13 are provided in side portions 12*b* opposite the wearer's ears so that the helmet does not interface with the wearer's hearing.

Some wearers may prefer an abbreviated or high cut version of the helmet having no such side portions 12*b*. Therefore, the shell 12 is formed in a mold which may either include or exclude the side portions 12*b* below the partition line L shown in phantom in FIG. 1.

As shown in FIG. 1, for reasons that will become apparent, the outer shell 12 is provided with a relatively small lateral slot 14 in the top portion 12*a* and may also have a larger lateral slot 16 at the rear of the shell as shown in FIG. 2. To shield such a slot 16, a pair of tabs 18 may be molded into the outer shell which tabs extend toward one another above and below slot 16. Tabs 18, if present, may be molded as part of the outer shell, but spaced from the outer surface of the shell per se. Thus, the tabs overlap the slot 16 thereby preventing sharp objects from projecting into the shell through that slot.

The tabs also function as an attachment device for a goggle strap S shown in phantom in FIG. 2. In other words, the strap S can be engaged under the tabs so that the strap encircles shell 12 so as to support a pair of goggles at the front of the helmet.

Figure 3:
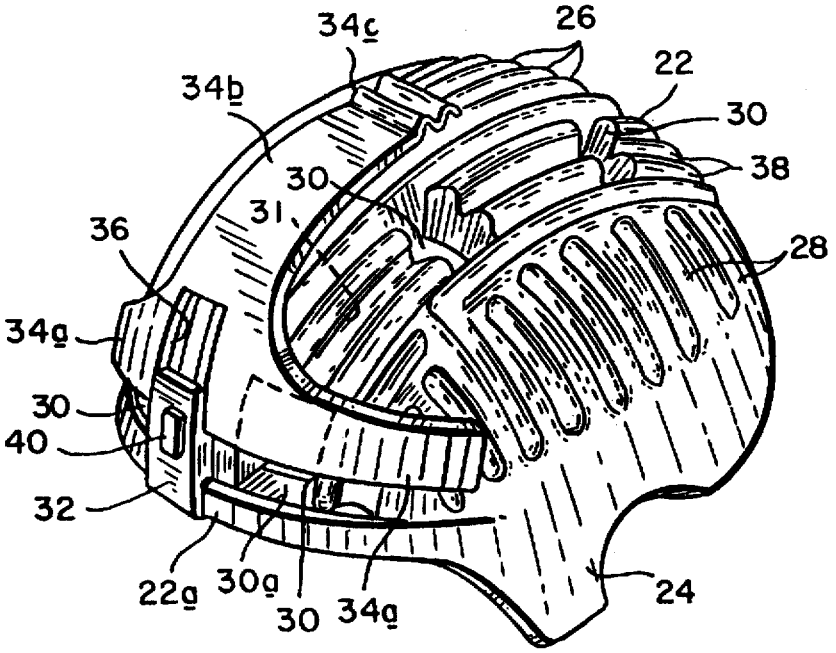
FIG. 3 is a perspective view showing the liner component of the FIG. 1 helmet in greater detail.

Referring now to FIGS. 1 to 3, the second major component of the helmet is a liner 22 which fits inside the recess defined by the outer shell 12. As best seen in FIG. 3, the liner 22 is a domed structure having an interior recess which is shaped more or less to fit the head of the helmet wearer. Preferably, it is provided with side openings 24 to provide clearance for the wearer's ears.

As best seen in FIG. 3, the outer surface of liner 22 is formed with a set of peaked ribs or corrugations 26 which may be parallel and extend over the top portion of the liner between the front and rear edges thereof. These ridges preferably have a generally triangular cross section and are relatively large, e.g., 0.375 inch base and 0.310 inch high. Similar ridges 28 are present at the sides of the liner.

However, ridges 28 are preferably oriented more or less perpendicular to ridges 26 to facilitate removing the liner from its mold by a single direction mold separation during the manufacturing process. Also molded into liner 22 at the time of its formation is an array of through-holes or chimneys 30. In the illustrated liner there are six such chimneys arranged in pairs, each chimney being at least about one inch square. One pair of chimneys is located adjacent to the front or leading edge of the liner on opposite sides of the liner centerline. Preferably, that edge is raised to form a ridge 22*a* that extends along the front edge of the liner below that pair of chimneys 30. Preferably also, the liner exterior surface is inclined or sloped between ridge 22*a* and the entrances to those chimneys 30, as shown at 30*a*, to provide air passage into those chimneys.

A second pair of chimneys is located just forward of the liner peak and the third pair is positioned just aft of the liner peak, the corresponding chimneys of each pair being aligned in the fore and aft direction.

Figure 4:
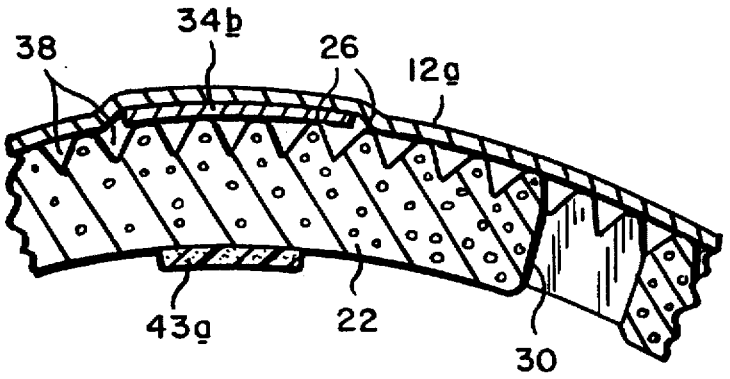
FIG. 4 is a sectional view taken along line 4—4 of FIG. 1, on a larger scale, showing the FIG. 1 helmet interior in greater detail.

As best seen in FIGS. 3 and 4, for reasons that will become apparent, the inner surface of liner 22 is relieved to form a channel 31 that extends fore and aft along the liner between the inner ends of the corresponding chimneys of each pair of chimneys. Preferably also, a generally rectangular boss 32 is present adjacent to the front edge of the liner between the foremost pair of chimneys 30. The boss 32 functions as a guide or key for a slider 34 that is positioned on the liner before the liner is seated in the outer shell 12.

In other words, gaps exist between the leading edge margin of shell 12 and the liner ridge 22*a* on opposite sides of liner boss 32 that provide air passage into air conduits 38 and the foremost chimneys 30 as shown by arrows A in FIG. 1.

The slider 34 is an inverted T-shaped plate having a pair of arms 34*a* projecting in opposite directions from the lower end of a leg 34*b*. The slider is resilient and curved to conform to the outer curvature of liner 22 and a slot 36 is provided at the lower end of leg 34*b* which is sized to receive the shell boss 32 so that the slider can slide up and down on liner 22. The slider 34 can be fabricated of any suitable resilient plastic material such as high density polyethylene.

When liner 22 is seated inside outer shell 12, the slide is positioned between the two so that the shell boss is received in slot 36 and the upper rippled end 34*c* of slider leg 34*b* extends out through the slot 14 at the top of outer shell 12. The interior surface of that shell may be relieved forward of the line 37 shown in FIG. 1 so that the slider can be moved fore and aft in the space between the liner and the outer shell by pushing or pulling on the slider end 34*c*. Elsewhere in the helmet, the tops or peaks of the ridges 26 and 28 of the liner contact the interior surface of outer shell 12 as best seen in FIG. 4. This forms a series of air conduits 38 between shell 12 and liner 22, corresponding to the valleys between ridges 26, that extend from the outer ends of the chimneys 30 at the leading edge of the liner back along the top area of the helmet to the slot 16 at the rear of the outer shell 12.

The liner 22 may be retained in position in shell 12 by double-faced adhesive strips 40 on boss 32 and on the back edge margin of liner 12 which strips adhere to the inner surface of shell 12.

The slider 34 functions as an air valve controlling air flow through the helmet. When the slider is moved to its closed position shown in FIG. 1 by pushing forward on the slider end 34*c*, the slider arms 34*a* seat against the liner ridge 22*a* and cover the entrances to the adjacent chimneys 30 and conduits 38 so there can be no circulation of air through the helmet.

However, when the slider is moved toward its open position as illustrated in FIG. 3 by pulling back on leg end 34c, the slider arms 34a are retracted away from the foremost chimney 30 entrances. Therefore, when the helmet wearer moves forward, air can enter those chimneys and also flow rearwardly along the conduits 38 to the entrances of the other pairs of chimneys and to the slot 16 in outer shell 12. The air that is forced into and through the chimneys 30 by the forward motion of the wearer flows along the channels 31 at the interior surface of liner 22 right next to the wearer's head thereby producing a significant cooling effect.

By appropriately adjusting the slider 34, the helmet wearer can control the amount of air flow through the helmet depending upon the ambient temperature, sun load on the helmet; amount of physical exertion on the part of the wearer, etc., to satisfy the wearer's comfort level. It is important to note that this venting function is accomplished without any direct openings in the outer shell 12 which might cause the helmet to fail established penetration testing standards.

In addition to performing the venting function described above, liner 22 also enables the helmet to absorb impacts over a wide range of G forces. More particularly, the ridged liner 22 is preferably molded of a crushable material such as 3 to 8 pound expanded polystyrene. This allows the liner and especially its peaked ridges 26, 28 to absorb impact forces which are well below the critical forces which would exceed the absorption capacity of the entire liner, yet which are still significant enough to cause head injury. In other words, for a small impact force, the crushing and fracturing of only the tips of the ridges 26, 28 may suffice to absorb the energy of that impact. Larger impact forces would result in the crushing and fracturing of a progressively larger volume percentage of the ridges. This progressive crushability of the liner 22 gives the helmet a progressively increasing absorption capacity equal to an increasing applied force up to the absorption capacity of the entire liner.

Figure 5:
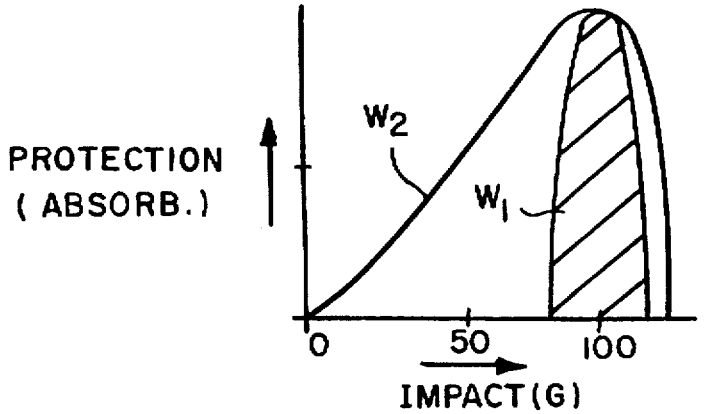
FIG. 5 is a graphical diagram comparing crushability characteristics of the liner in the FIG. 1 helmet and a conventional liner.

Refer now to FIG. 5 which is a graph comparing the impact absorption range of the FIG. 1 helmet employing a crushable ridged liner and a helmet equipped with a traditional liner with smooth surfaces. In FIG. 5, the waveform $W_1$ shows the variation of acceleration over time for a conventional helmet. From waveform $W_1$ it can be seen that the conventional helmet provides good impact absorption against strong impacts of 100 G's or more but provides relatively little protection at force levels below 50 G's. On the other hand, from waveform $W_2$ it can be seen that while the subject helmet is also able to absorb high energy impacts, it has a vastly improved protection range at less than critical force levels which are still significant enough to cause head injury.

The subject helmet preferably also includes a soft resilient inner liner 43 as shown in FIG. 1. Inner liner 43 may be fabricated of a memory foam material with an outer fabric skin and may be glued inside the edge margin of shell 12 particularly at the side portions 12b thereof. A strip 43a of similar material may be adhered to the inner surface of liner 22 at the top of the liner as shown in FIG. 4 to cushion the top of the helmet. A suitable memory foam material is marketed by Ear Incorporated under the name Conforfoam.

Desirably also, a chin strap 44 is provided composed of two sections 44a and 44b. Each section has a bifurcated end that is riveted at two points 45 (FIG. 1) to shell 12 at a side of the shell. The opposite or free ends of the two strap sections may be releasably connected together by suitable connector means 46, e.g., a buckle, snap fastener, hook-and-loop fastener, etc.

It will thus be seen that the objects set forth above among those made apparent from the preceding description, are efficiently attained. Also, certain changes may be made in the above helmet construction without departing from the scope of the invention. For example, if it is desired to have a shell 12 with no openings at all, slot 16 may be omitted in which case the venting air may exit the helmet through gaps between the exterior surface of the liner and the outer shell at the rear edge of the liner and shell. Therefore, it is intended that all matter contained in above description or shown in the accompanying drawings shall be interpreted as illustrative and not in a limiting sense.

It is also to be understood that the following claims are intended to cover all of the generic and specific features in the invention described herein.

I claim:

1. A safety helmet comprising a hard outer shell defining a recessed interior and having front and rear edges;

a bowl-shaped liner having front and rear edges and a peak between said edges, said liner being contoured to fit snugly in the shell so that the front and rear edges of the liner are adjacent to the front and rear edges of the shell, said liner also having an interior surface contoured generally to fit a wearer's head and a corrugated exterior surface, of the liner corrugations having tips which contact the shell along multiple lines of contact and the corrugations in at least a central zone of the liner adjacent to said peak extending fore and aft between the front and rear edges of the liner such that the corrugations define valleys that are spaced from the shell to provide air passages extending between the front and rear edges of the liner, and a plurality of through-holes in said liner each through-hole communicating between said air passages and said liner interior surface.

2. The helmet defined in claim 1 and further including an inner liner of a resilient material that underlies at least a portion of the outer shell.

3. The helmet defined in claim 1 wherein the crush resistance of the ridges increases in proportion to the strength of the impact force on the helmet.

4. The helmet defined in claim 3 wherein the crush resistance increases substantially linearly with increased impact force.

5. The helmet defined in claim 1 wherein said corrugations have generally triangular cross sections.

6. The helmet defined in claim 1 when said liner is of expanded polystyrene.

7. The helmet defined in claim 1 and further including an inner liner of a resilient material underlying at least a portion of said outer shell.

8. The helmet defined in claim 1 and further including securing means attached to the shell for securing the helmet to a wearer's head.

9. A safety helmet comprising a hard outer shell defining a recessed interior and having front and rear edges;

a bowl-shaped liner having front and rear edges and a peak between said edges and contoured to fit snugly in said shell so that the front and rear edges of the liner are adjacent to the front and rear edges of the shell, said liner also having an inner surface contoured generally to fit a wearer's head and an exterior surface which is corrugated so that the peaks of the corrugations form multiple lines of contact with the shell, said corrugations being of a crushable material so that impact forces on the shell are progressively absorbed by the liner.

10. The helmet defined in claim 9 wherein the crush resistance of said corrugations increases in proportion to the strength of the impact force on the helmet.

11. The helmet defined in claim 10 wherein the crush resistance increases substantially linearly with increasing impact force on the helmet.

12. The helmet defined in claim 9 wherein said corrugations have generally triangular cross sections.

13. The helmet defined in claim 9 wherein the entire liner is of a crushable material.

14. The helmet defined in claim 13 wherein the liner is of expanded polystyrene.

15. A safety helmet comprising a hard shell defining a recessed interior and having front and rear edges and no unobstructed openings into the shell;

a bowl-shaped liner having front and rear edges and a peak between said edges, said liner being contoured to fit snugly in the shell with the front and rear edges of the liner being adjacent to the front and rear edges of the shell, said liner also having an exterior surface facing said shell and an interior surface contoured generally to fit a wearer's head;

at least one through-hole in the liner, said at least one through-hole having a first end at said exterior surface of the liner and a second end at said liner interior surface;

an air passage between the exterior surface of the liner and shell which air passage extends from the front edges of the liner and shell to the first end of said at least one through-hole so that air entering said air passage is conducted by said at least one through-hole to the interior surface of the liner.

16. The helmet defined in claim 15 and further including valve means movably mounted in the shell for controlling air flow through said air passage and said at least one through-hole.

17. The helmet defined in claim 16 wherein the valve means include a slider slideably positioned between the shell and the liner said slider being slideable between a closed position wherein the slider extends to the front edges of the shell and liner so as to prevent air from entering said air passage and said at least one through hole and an open position wherein the slider is retracted from the front edges of the shell and liner so that it does not impede air flow through said air passage and said at least one through-hole.

18. The helmet defined in claim 16 wherein said liner is of a crushable material.

19. The helmet defined in claim 18 wherein said liner exterior surface is irregular so that it contacts said shell along multiple lines of contact whereby the liner has a progressive crushability characteristic.

20. A safety helmet comprising a hard outer shell defining a recessed interior and having front and rear edges;

a bowl-shaped liner having front and rear edges and a peak between said edges, said liner being contoured to fit snugly in the shell so that the front and rear edges of the liner are adjacent to the front and rear edges of the shell, said liner also having an interior surface contoured generally to fit a wearer's head and a corrugated exterior surface, the liner corrugations having tips which contact the shell along multiple lines of contact and the corrugations in at least a central zone of the liner adjacent to said peak extending fore and aft between the front and rear edges of the liner such that the corrugations define valleys that are spaced from the shell to provide air passages extending between the front and rear edges of the liner;

a plurality of through-holes in said liner, each through-hole communicating between said air passages and said liner interior surface, and a vent opening in the shell adjacent to the rear edge of the liner and in communication with said air passages.

21. A safety helmet comprising a hard outer shell defining a recessed interior and having front and rear edges;

a bowl-shaped liner having front and rear edges and a peak between said edges, said liner being contoured to fit snugly in the shell so that the front and rear edges of the liner are adjacent to the front and rear edges of the shell, said liner also having an interior surface contoured generally to fit a wearer's head and a corrugated exterior surface, the liner corrugations having tips which contact the shell along multiple lines of contact and the corrugations in at least a central zone of the liner adjacent to said peak extending fore and aft between the front and rear edges of the liner such that the corrugations define valleys that are spaced from the shell to provide air passages extending between the front and rear edges of the liner;

a plurality of through-holes in said liner, each through-hole communicating between said air passages and said liner interior surface, and recesses in the interior surface of said liner that extend between said through-holes.

22. A safety helmet comprising a hard outer shell defining a recessed interior and having front and rear edges;

a bowl-shaped liner having front and rear edges and a peak between said edges, said liner being contoured to fit snugly in the shell so that the front and rear edges of the liner are adjacent to the front and rear edges of the shell, said liner also having an interior surface contoured generally to fit a wearer's head and a corrugated exterior surface, the liner corrugations having tips which contact the shell along multiple lines of contact and the corrugations in at least a central zone of the liner adjacent to said peak extending fore and aft between the front and rear edges of the liner such that the corrugations define valleys that are spaced from the shell to provide air passages extending between the front and rear edges of the liner;

a plurality of through-holes in said liner, each through-hole communicating between said air passages and said liner interior surface, and valve means movably mounted in the shell for controlling air flow through said passages and said through-holes.

23. The helmet defined in claim 22 wherein the valve means include a slider slideably positioned between the shell and the liner said slider being slideable between a closed position wherein the slider extends to the front edges of the shell and liner so as to prevent air from entering said air passages and said through holes and an open position wherein the slider is retracted from the front edges of the shell and liner so that it does not impede air flow through said passages and said through-holes.

24. A safety helmet comprising .

a hard outer shell defining a recessed interior and having front and rear edges;

a bowl-shaped liner having front and rear edges and a peak between said edges, said liner being contoured to fit snugly in the shell so that the front and rear edges of the liner are adjacent to the front and rear edges of the shell, said liner also having an interior surface contoured generally to fit a wearer's head and a corrugated exterior surface, the liner corrugations having tips which contact the shell along multiple lines of contact and the corrugations in at least a central zone of the liner adjacent to the peak extending fore and aft between the front and rear edges of the liner such that the corrugations define valleys that are spaced from the shell to provide air passages extending between the front and rear edges of the liner, said liner corrugations comprising ridges of a crushable material so that relatively low impact forces on the helmet are absorbed by progressive fracture of the ridges, said exterior surface of the liner also having corrugations in side zones of the liner on opposite sides of said central zone, said side zone corrugations being oriented at a relatively sharp angle with respect to the central zone corrugations to facilitate molding the liner, and a plurality of through-holes in said liner, each through-hole communicating between said air passages and said liner interior surface.

25. A safety helmet comprising a hard outer shell defining a recessed interior and having front and rear edges;

a bowl-shaped liner having front and rear edges and a peak between said edges, said liner being contoured to fit snugly in the shell so that the front and rear edges of the liner are adjacent to the front and rear edges of the shell, said liner also having an interior surface contoured generally to fit a wearer's head and a corrugated exterior surface, the liner corrugations having tips which contact the shell along multiple lines of contact and the corrugations in at least a central zone of the liner adjacent to said peak extending fore and aft between the front and rear edges of the liner such that the corrugations define valleys that are spaced from the shell to provide air passages between the front and rear edges of the liner, and valve means movably mounted in the shell for controlling air flow through said air passages.

* * * * *